US006502734B1

(12) United States Patent
Umlauf

(10) Patent No.: US 6,502,734 B1
(45) Date of Patent: Jan. 7, 2003

(54) DRIVER SYSTEM FOR REDUCING THE SPEED OF OR DRAGGING METAL STRIPS

(76) Inventor: Norbert Umlauf, Haferkamp 64, D-58093 Hagen (DE)

( * ) Notice: Subject to any disclaimer, the term of this patent is extended or adjusted under 35 U.S.C. 154(b) by 0 days.

(21) Appl. No.: 09/600,091

(22) PCT Filed: Nov. 10, 1999

(86) PCT No.: PCT/EP99/08606

§ 371 (c)(1),
(2), (4) Date: Sep. 18, 2000

(87) PCT Pub. No.: WO00/27554

PCT Pub. Date: May 18, 2000

(30) Foreign Application Priority Data

Nov. 11, 1998 (DE) ..... 198 52 078
Nov. 11, 1998 (DE) ..... 298 20 111 U
Apr. 19, 1999 (DE) ..... 299 09 850 U

(51) Int. Cl.[7] ..... B65H 20/00; B65H 23/08
(52) U.S. Cl. ..... 226/172; 226/195; 242/418.1
(58) Field of Search ..... 226/168, 172, 226/195; 242/418.1

(56) References Cited

U.S. PATENT DOCUMENTS 3,481,523 A * 12/1969 Frank et al. ..... 226/172
3,620,432 A * 11/1971 Emery ..... 226/172
3,826,442 A * 7/1974 Bethke ..... 242/418.1
3,973,770 A * 8/1976 Montenbruck ..... 226/172 X
4,039,109 A * 8/1977 Rhodes ..... 226/172
4,527,723 A * 7/1985 Umlauf ..... 226/172
4,792,075 A * 12/1988 Umlauf ..... 226/172

FOREIGN PATENT DOCUMENTS

| | | |
|---|---|---|
| DE | 1288865 | 2/1969 |
| DE | 19524289 | 1/1997 |
| EP | 0088347 A * | 9/1983 |
| EP | 0195096 | 9/1986 |

* cited by examiner

*Primary Examiner*—Michael R. Mansen
(74) *Attorney, Agent, or Firm*—Sidley Austin Brown & Wood, LLP

(57) ABSTRACT

A device for drawing or braking metal bands or metal sheets and including two oppositely arranged endless revolving chain systems with a gap therebetween through which a metal band or a metal sheet is displaced and including carriage-like roller blocks for effecting one of clamping and driving the one of a metal band and a metal sheet, an elastic lining for covering the roller blocks; a plurality of shaping and filler pieces for controlling tension applied to the elastic lining; and elements for generating magnetic fields for controlling driving and/or restraining forces applied to the metal band or the metal sheet.

2 Claims, 6 Drawing Sheets

DRIVER SYSTEM FOR REDUCING THE SPEED OF OR DRAGGING METAL STRIPS

TECHNICAL FIELD

The invention relates to driving systems in a device for drawing or braking metal bands or sheets, preferably in band lines between endlessly revolving chain systems.

PRIOR ART

EP-A-0088347 and EP-A-0195096 disclose a braking stand for metal or sheet bands with which the tensile or braking force required during the braking of metal bands can be applied to the surface of the split or non-split band without damaging effects.

The use of the eddy-current effect for braking electrically conductive metal band is described in DE-B 1 288 865. This embodiment is used in practice. The fundamental disadvantage consists in the fact that the desired function does not appear in a useful manner until a band speed of about 50 m/min is reached. The band tension could only be controlled by a change in spacing. The result was unsatisfactory, since, at too close a spacing, contact with the magnet caused relative movements.

A further eddy-current brake is described in laid-open specification DE 195 24 289 A1. The essential difference consists in the fact that the permanent magnets are moved on a circular path. Only one magnetic path is available for the retention effect. In addition, the parallelism of the permanent magnets appears for only a fraction of the period, as a result of which the retention effect is built up in an uneven and substantially reduced manner. In order to be able to apply sufficient specific band tension, the rotational speeds of the braking rollers would have to be brought to orders of magnitude which are no longer controllable. In addition, high drive outputs at a very unfavorable efficiency occur.

DESCRIPTION OF THE INVENTION

The problem underlying the invention is to extend the possible uses of the known braking stand on the one hand and to achieve a specific behavior which is different for the various tasks on the other hand, in particular for the entry, exit and driving conditions of the carriage-like roller blocks in the band-driving region.

This problem is solved by shaping, which produces robust support in the central region. The entry and exit must be of elastic configuration. The design is such that high elasticity in the horizontal direction (band tension direction) is achieved. Furthermore, negligible squeezing is achieved with the invention, as a result of which the flexing work at the entry and exit can be decisively reduced. The lining width corresponds to the chain pitch. The arrangement is made between the running rollers. It is possible with this design to provide a closed contact surface in the driving region. This design requires the synchronous running of the top carriage chain relative to the bottom carriage chain.

A low lining hardness with a relatively thick lining is preferably selected. The metal band is embedded, so that the form errors of the metal band in cross section and the band waviness are compensated for without problem. The clearance spaces created enable the squeezed volume of the elastic lining to flow in a specific manner.

The lining is given a filling piece, e.g. flat-bar steel. This enables the squeezing to be adapted in a specific manner to the functional task by means of stress concentration factor, while the desired inclination of the lining in the tension direction can be effected virtually without restriction.

An appropriate applications [sic] consists in the fact that only one revolving carriage chain is designed as a revolving table. In this case, forces are induced in the band by means of permanent magnets or via electromagnets in order to be able to apply braking or tensile forces. Magnetizable metal band is pulled by the forces of attraction onto the protective strap of the carriage chain and driving forces are produced in accordance with the $\mu$-value.

As a further possibility it is suitable for two revolving rollers to be equipped with permanent magnets or with electromagnets and for a parallel, linear, magnetic traveling field to be built up by the applied magnet poles, this magnetic traveling field acting as a linear, revolving eddy-current brake in the electrically conductive band material.

The metal band is heated if the energy is supplied conductively or inductively via the revolving system. This effect may likewise be used in galvanic or other processes.

If the revolving system is equipped with electronic measuring heads, the band thickness, the surface condition, the metallic structures and the like, for example, can be tested very accurately since the metal band and the test head can work in a fixed position for a certain time at identical speed.

An optimum mode of operation is achieved if the mechanical linear drive is operated by an electric linear drive. This embodiment loads the carriage-chain system only in the linear driving region and is therefore appropriate in particular for large forces and high speeds.

If the braking stand is placed in position on a control frame at pass line height, extremely precise control of the band with regard to the band center or band edge becomes possible, since the tilting moment is "designed out" by this measure. As a result, fluctuations in tension due to vibrations are avoided. This is an important aspect for rolling, stretching, bending and straightening processes.

The braking stand or the control frame may be extended by a band-tension measuring frame. In this case, these units hang in leaf springs. The reaction forces of the band tension are recorded without distortion via measuring cells. This measuring system is able to measure exclusively the horizontal forces with a high repetitive accuracy and, depending on the measuring range, can be set to a few newton.

For high demands, for example in the case of bands of very high surface sensitivity, such as copper or aluminum band, special effects become possible due to the invention, to be precise due to the specific feeding of the chains having the roller blocks into a relatively short clamping and driving region by means of straight guide strips, which at the same time enable the clamping forces to be absorbed. In this way, relatively large pressure forces can be absorbed, these pressure forces being necessary in order to ensure large tensile or retention forces without relative movement between the band and the revolving, carriage-like roller blocks. The specific feeding of the roller blocks is achieved by entry and exit curves at the straight guide strips of the driving region. A highly elastic transition is made possible by specific shaping. The squeezing of the elastic lining is specifically reduced by the insertion of shaped plates.

The design of the electric linear drive has the advantage that the hinge ends of the chain-carriage link plates are only loaded by the deflection and centrifugal forces, whereas the loads from the band tension to be applied only act in the driving region. The dimensioning of the hinges may therefore be restricted to the deflection and centrifugal forces. The wear is thereby minimized.

The driving section may be configured in such a way that current is fed to the metal band conductively or inductively. This solution is preferably used in galvanic processes, when heating the band, for measuring processes on the band and for the build up of magnetic fields, which are used for inducing retention forces. For the current feed, electrically conductive materials are put into the carriage-like roller blocks. The current can be switched on specifically when the roller blocks pass through the driving region. Apart from a better efficiency compared with conventional gas- or oil-fired annealing furnace installations, a great advantage of this measure consists in the fact that the energy supply can be switched off at any time. When the eddy-current method is used, the band tension can be controlled by the opposed speed of the chain carriages, and the retention force can be controlled by varying the frequency.

If the lining carriers of the carriage-chain system are equipped with measuring probes, ideal analyzing conditions are provided by the revolving table. The task of the revolving carriage-chain system is to carry the band and to ensure a fixed band distance from the measuring heads or magnet coils. The dwell time for the test operation can be set by establishing the contact section, since the metal band and the carriage-chain system have the same speed in this region. The application is suitable for band-thickness measurements, stress measurements in the band, surface scanning and other test systems. The current may alternatively be fed from the inside or laterally from outside. The current is switched on and off after the chain carriage has reached the parallel section or before it leaves the parallel section.

Individual magnets or magnet coils, which pass over the entire segmented region, can be supplied with voltage according to the same system. The band is pulled onto the chain carriage via the magnetic forces of attraction. Band tension can be applied via the chain-carriage system as a function of these forces and the $\mu$-value. This is also possible by means of permanent magnets. This design is suitable for magnetizable metal bands.

BRIEF DESCRIPTION OF THE DRAWINGS

The invention is explained in more detail below with reference to the exemplary embodiments shown in the drawings, in which.

WAYS OF IMPLEMENTING THE INVENTION

The arrangement shown has the great advantage that the individual band strips can be fed tangentially to the winding reel 1, 2 without a deflection sheave. The reverse tension built up in the braking stand 5, 6 is brought to the take-up point without deflection losses and without relative movements. In this way, ideal preconditions are created for a uniform specific distribution of band tension. The tangential feeding is continuously adjusted. Numeral 1 shows the winding mandrel of the winding reel, 2 shows the wound coil, 3 shows the third separation for the band strips, 4 shows the metal band, 5 shows the top revolving roller, 6 shows the bottom revolving roller, 7 shows the second separation and 8 shows the first separation, in order to feed the metal band to the braking stand at right angles from the loop 9, and 10 shows the splitting shears.

Figure 1:
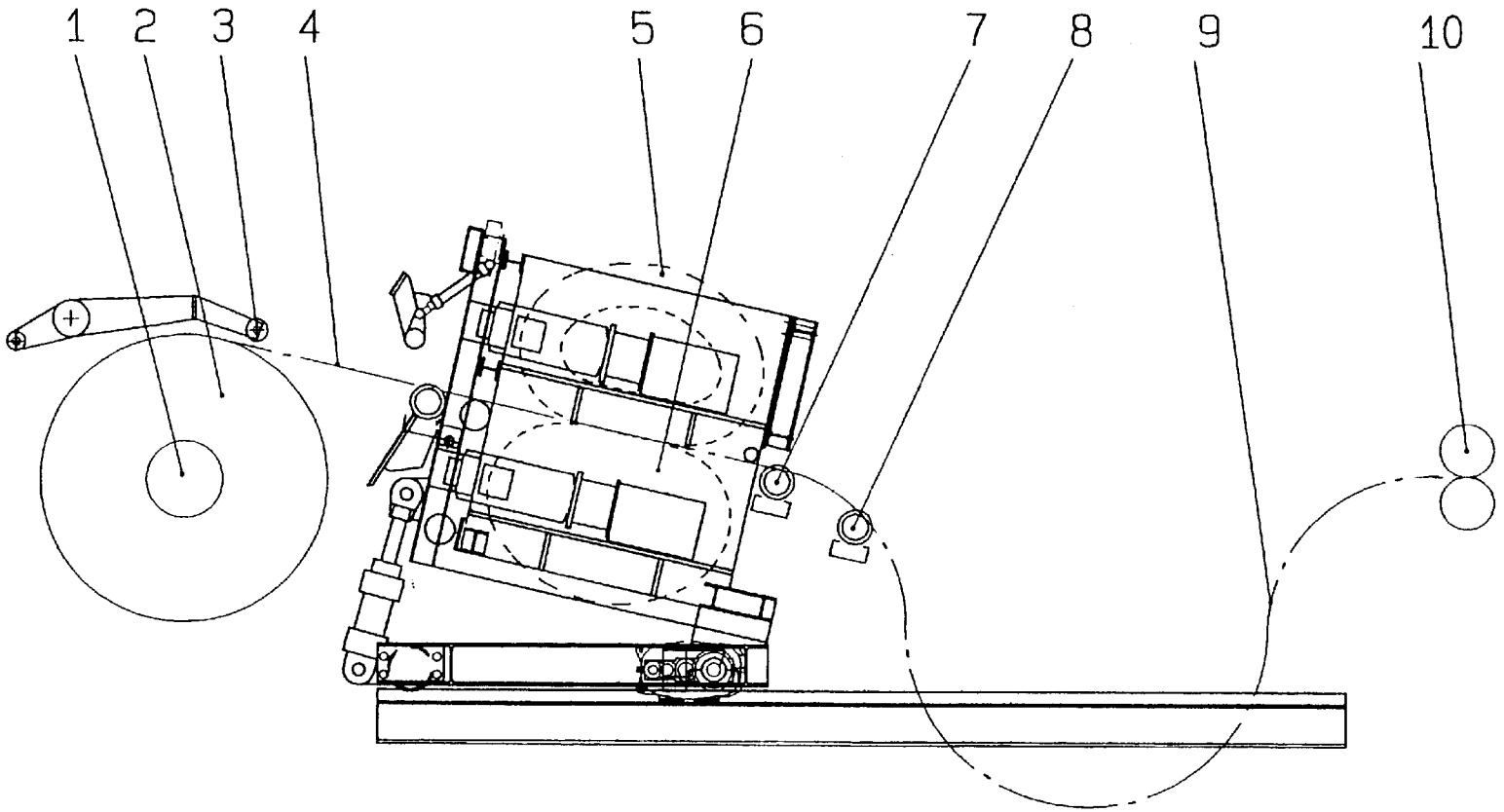
FIG. 1 shows a split-band braking stand.
Figure 2:
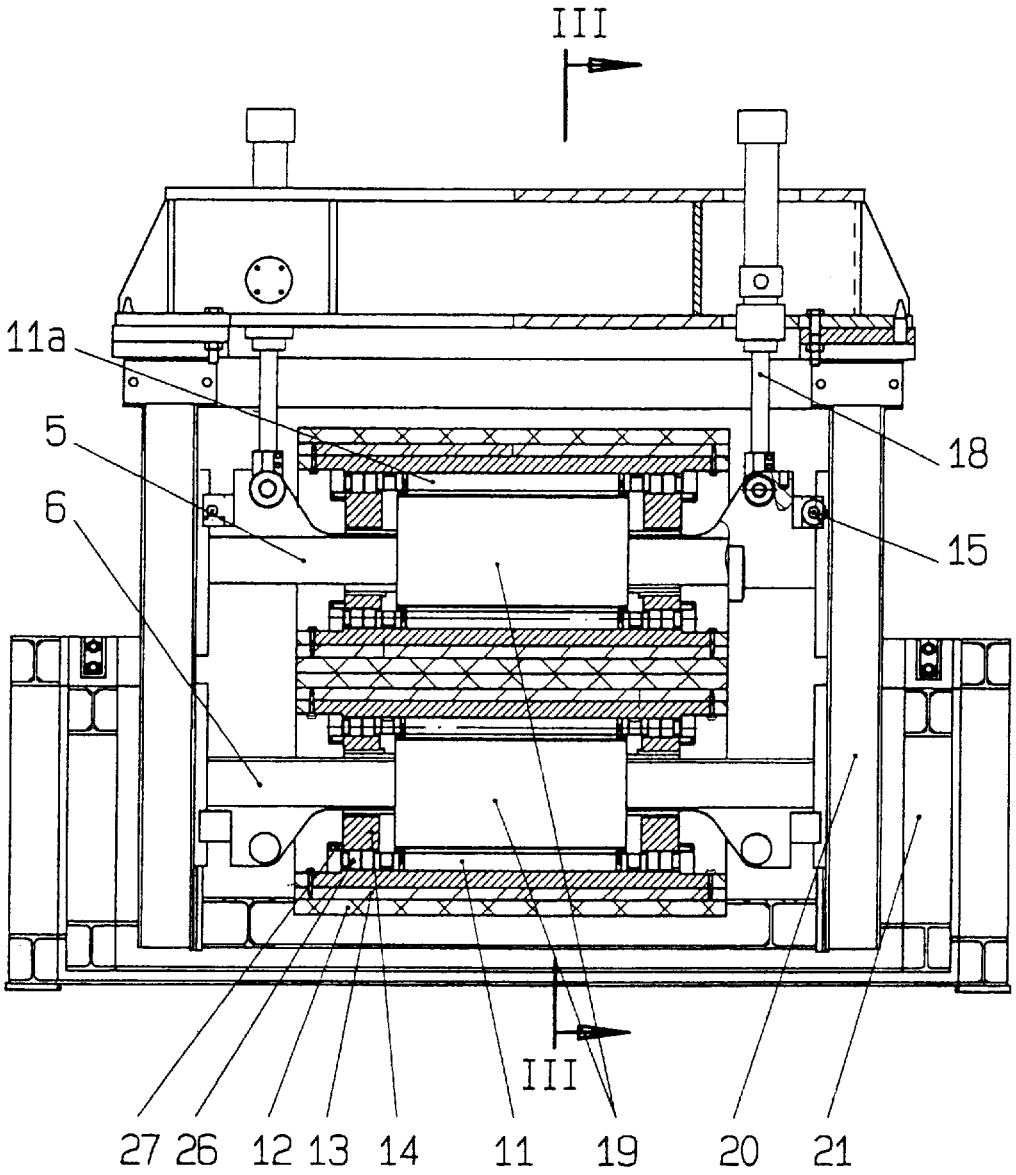
FIG. 2 shows the front view of a braking stand with control and measuring frames, partly sectioned.
Figure 3:
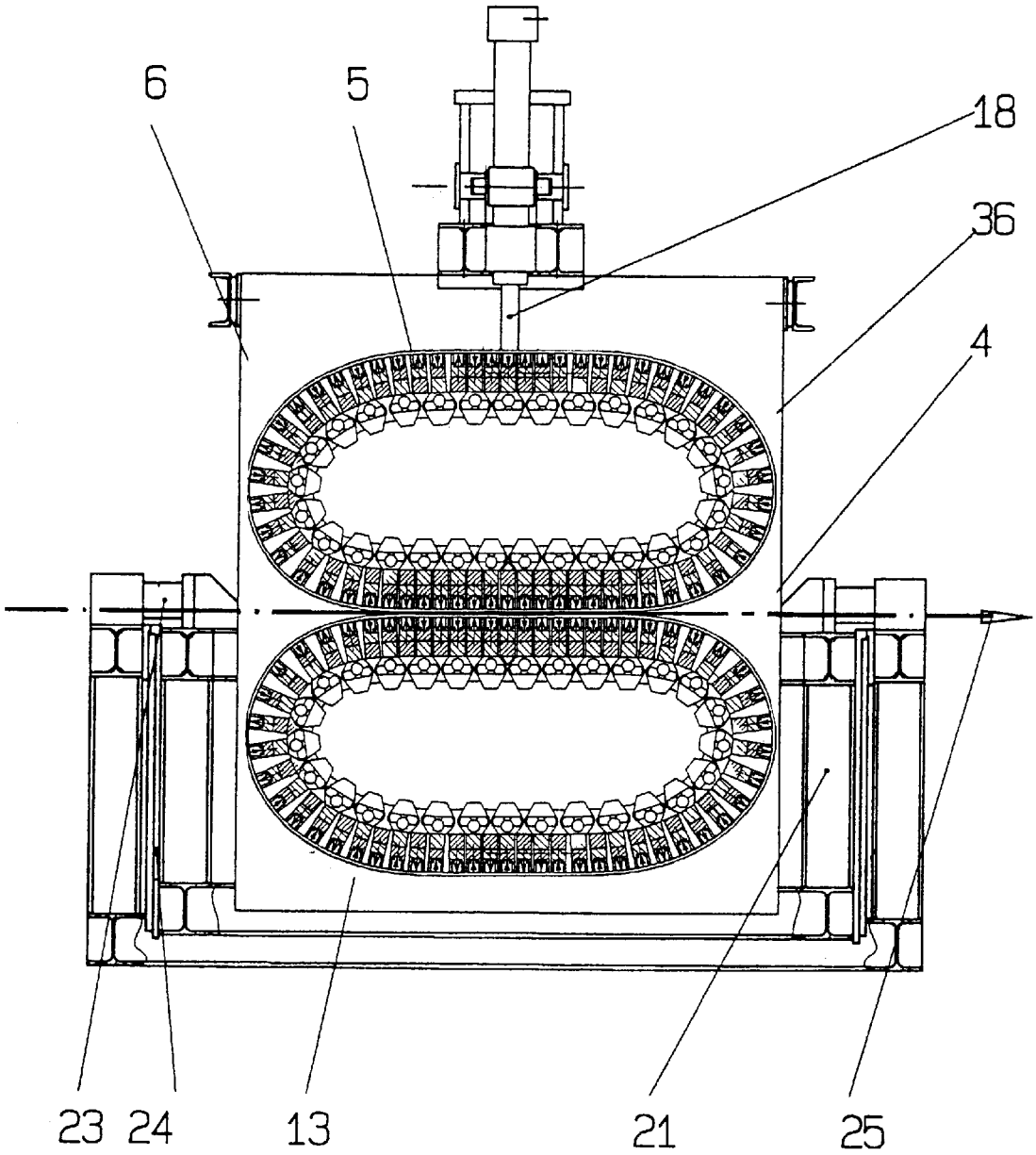
FIG. 3 shows the side view of a braking stand with control and measuring frames, partly sectioned along line III—III in FIG. 2.

The special feature of this solution according to FIG. 2 consists in the fact that the mechanical linear drive is moved by an electric linear drive 19. This solution enables high band tension to be induced in the metal band in the quickest way. During the deflections, only the forces from the centrifugal forces and hinge movements arise for the carriage chain. The carriage chain 11 can be of simple configuration. The entire drive chain consists of shaft with the sprockets, universal shaft, gear unit, clutch and electric motor. Substantially higher speeds with at the same time high band tension can be coped with without problem. Numeral 12 shows the elastic segmented lining, 13 shows the lining carrier, 14 shows the running rail.

The braking stand 20 hangs by means of leaf springs 24 in the control frame 21. The band tension can be measured with very low hysteresis and very high repetitive accuracy by means of weighing cells 23 without distortion by deflections. The braking and tension stand 20 consists of the upright and revolving rollers 5 and 6, which are arranged opposite one another and are fitted in guides of the uprights 20 and of which the top revolving roller 5 is set against the bottom revolving roller 6 by means of cylinder-pressurized piston rods 18.

The chains 11 and 11*a* are composed of a multiplicity of carriage-like roller blocks, which are coupled to each other, extend over the entire width of a band 4 entering in arrow direction 25 and, with supporting wheels 26, at least on both sides, and lateral guide rollers 27, roll on a track or are in lateral contact with the latter. The track is run to a driving region, in which the opposite roller blocks 11 take hold of the band 4 on both sides and clamp it between them.

Figure 5B:
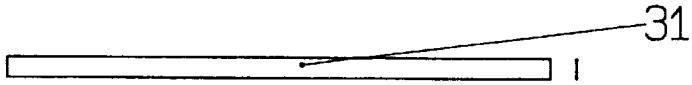
FIG. 5B shows a first embodiment of a shaping and filler piece according to the present invention.
Figure 5C:
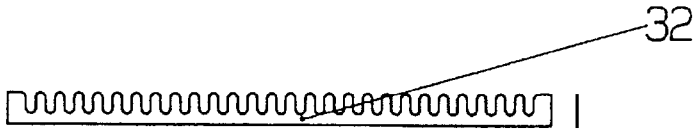
FIG. 5C shows another embodiment of a shaping and filler piece according to the present invention.
Figure 5A:
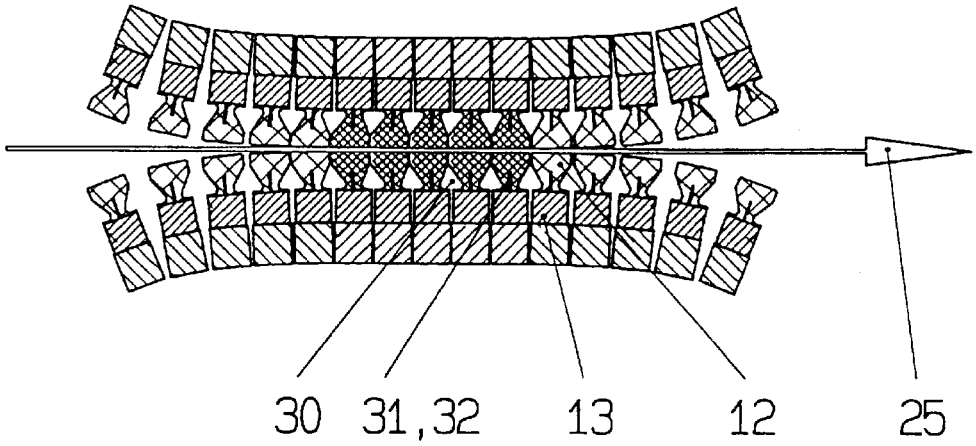
FIG. 5A shows a possible elastic lining shown in FIG. 4 under a different loading state.
Figure 4:
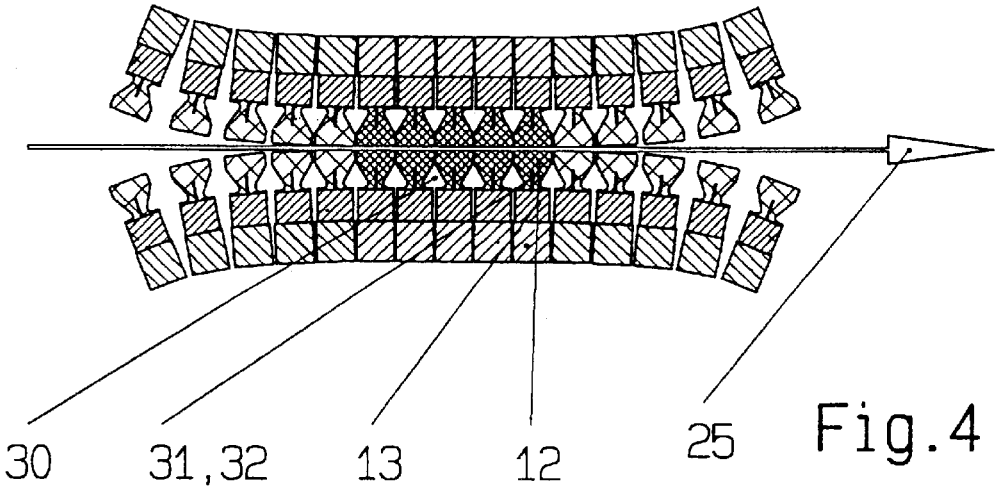
FIG. 4 shows a possible elastic lining.
Figure 6B:
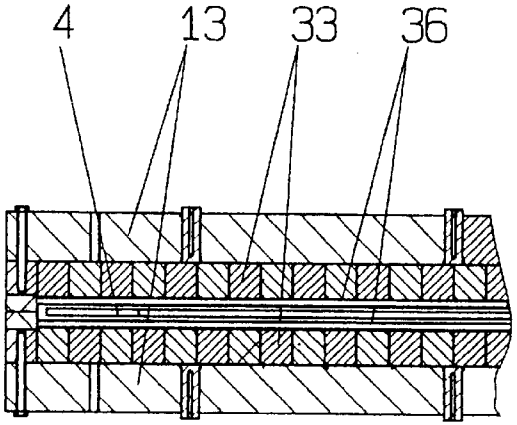
FIG. 6B shows an eddy-current system shown in FIG. 6A using permanent magnets.
Figure 6C:
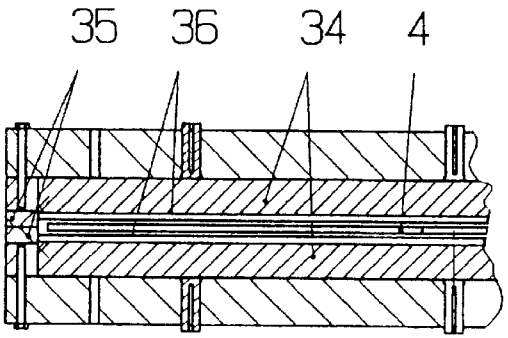
FIG. 6C shows an eddy-current system shown in FIG. 6A using magnetic coils.
Figure 6A:
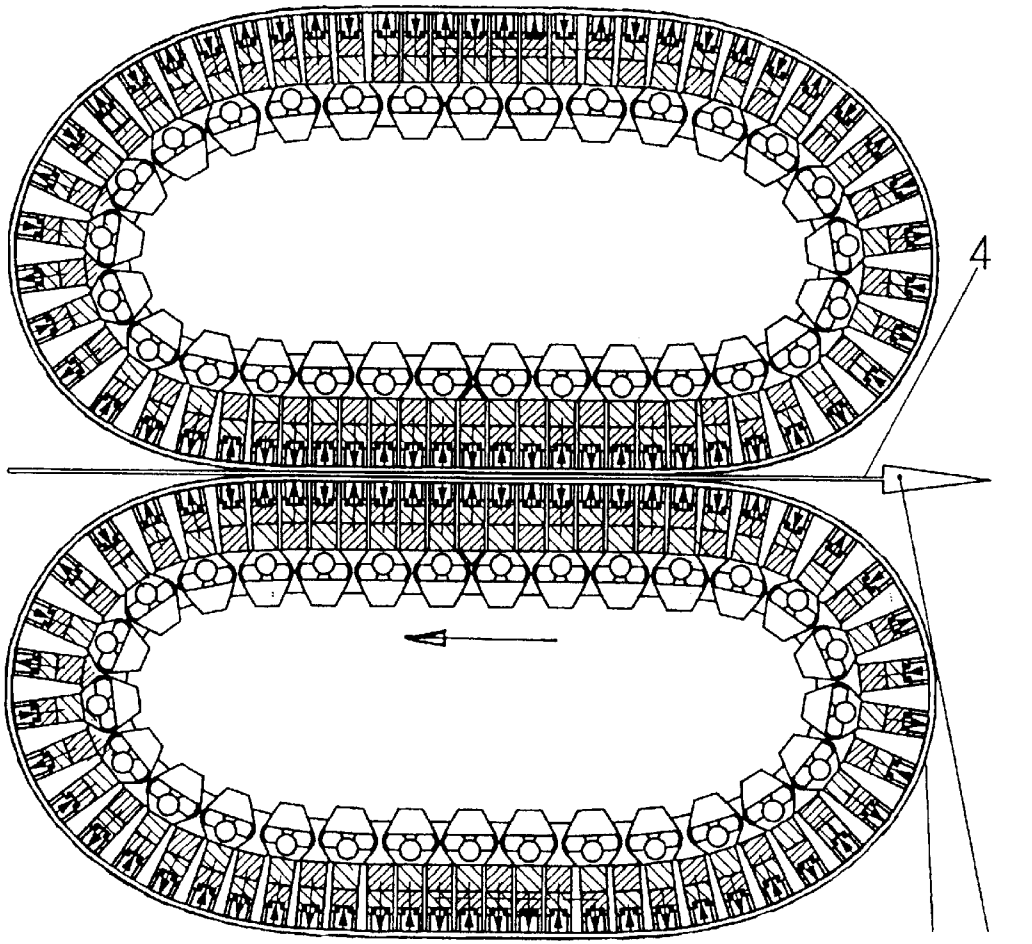
FIG. 6A shows an eddy-current system used with a device according to the present invention.

The lining carriers 13 are provided with an elastic lining 12. The lining width corresponds to the chain pitch T and extends within the axles of the supporting wheels 26 of two adjacent, i.e. successive, blocks. The axles at the same time for a defined center of rotation. The lining 12 is configured by clearance spaces 30 in such a way that an especially elastic adaptation of the squeezed lining is possible on the entry and exit side. The squeezing height of the lining should be as low as possible in order to keep the flexing work as slight as possible. At the same time, the lining must be given very high elasticity in the band tension direction in order to permit different band speeds for the individual split-band strips via the different inclination of the lining, as shown in FIG. 6A. The eddy-current system shown in FIG. 6A can be used with permanent magnets (FIG. 6B) with magnetic coils (FIG. 6C). This functional variance has been achieved according to the invention so that the squeezing height can be adapted to the task via the stress concentration factor by means of the supporting plates 31 and 32, shown in FIGS. 5B and 5C, but the inclination of the lining is only restricted to a negligible degree. FIG. 4A shows the position of the lining with slight band tension, and FIG. 5A shows the position of the lining with high band tension.

If the lining carriers 13 are fitted with permanent magnets 33 or magnet coils 34, which build up eddy-current fields, electrically conductive bands, in particular bands of aluminum, copper and their alloys, may be used for inducing band tension. In this case, the carriage chain, as a rule, is moved against the band running direction. The length of the contact section may be adapted to the requirements.

This embodiment according to FIGS. 2. 6A–6C is of great interest for metal bands having the highest surface demands, since there is no contact with the braking system. The distance between the permanent magnets 33 or coils 34 can be kept constant by the supports of the revolving rollers being set by the elastic blocks 35. The metal band 4 levitates between the permanent magnets 33 or the coils 34 due to the forces of attraction. The protective strap 36 is also shown.

If the lining carriers 13 are fitted with permanent magnets 33 or magnet coils 34 which build up magnetic fields, magnetizable metal bands may be used for inducing band tension. In this case, the carriage chain is moved in the band running direction. The length of the contact section may be adapted to the requirements.

Figure 7B:
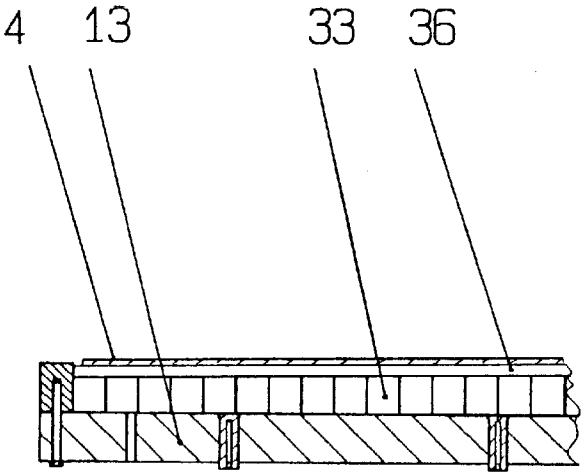
FIG. 7B shows the system of FIG. 7A equipped with permanent magnets.
Figure 7A:
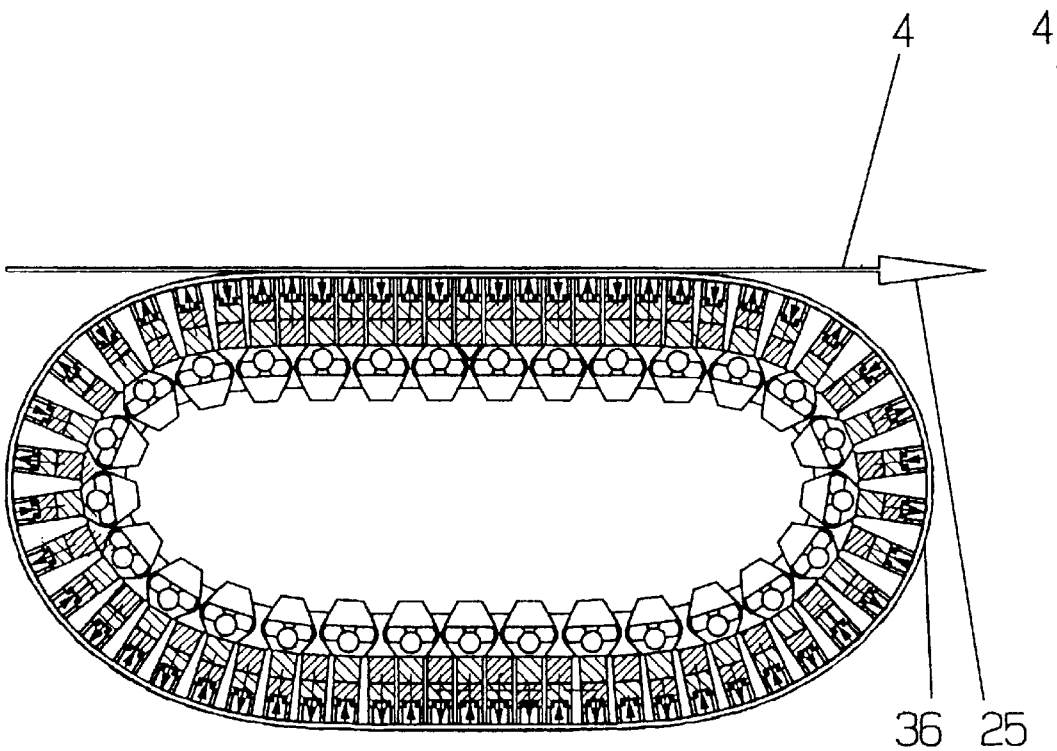
FIG. 7A shows forward and reverse tension by magnetic fields.

FIG. 7A shows forward and reverse tension of the metal band by magnetic fields which can be produced by permanent magnets as shown in FIG. 7B.

This embodiment is of great interest for metal bands having the highest surface demands, since there is contact with the braking system only on one side.

What is claimed is:

1. A device for effecting one of drawing and braking one of metal bands and metal sheets, the device comprising two oppositely arranged endless revolving chain systems forming a gap there between, in which one of a metal band and metal sheet is displaced, and including carriage-like roller blocks for effecting one of clamping and driving the one of a metal band and a metal sheet; elastic lining means for covering the roller blocks; a plurality of supporting plates acting on the elastic lining means for controlling tension applied to the elastic lining means; and means for generating magnetic fields for a controlling at least one of driving and restraining forces applied to the one of a metal band and a metal sheet, wherein the magnetic fields generating means comprising magnet coils attached to the roller blocks.

2. A device for effecting one of drawing and braking one of metal bands and metal sheets, the device comprising two oppositely arranged endless revolving chain systems forming a gap there between, in which one of a metal band and metal sheet is displaced, and including carriage-like roller blocks for effecting one of clamping and driving the one of a metal band and a metal sheet; elastic lining means for covering the roller blocks; a plurality of supporting plates acting on the elastic lining means for controlling tension applied to the elastic lining means; and means for generating magnetic fields for a controlling at least one of driving and restraining forces applied to the one of a metal band and a metal sheet, wherein the magnetic field generating means comprises permanent magnets attached to the roller blocks.

* * * * *